United States Patent [19]

Small

[11] Patent Number: 4,905,617

[45] Date of Patent: Mar. 6, 1990

[54] HANDLING APPARATUS

[75] Inventor: Mason S. Small, Leeds, England

[73] Assignee: Automated Machinery Systems, Inc., Richmond, Va.

[21] Appl. No.: 318,350

[22] Filed: Mar. 3, 1989

[30] Foreign Application Priority Data

Mar. 8, 1988 [GB] United Kingdom ..... 8805442

[51] Int. Cl.[4] ..... D05B 23/00; D05B 21/00

[52] U.S. Cl. ..... 112/121.22; 112/121.12

[58] Field of Search ..... 112/121.22, 121.11, 112/121.12, 121.15, 170, 94

[56] References Cited

U.S. PATENT DOCUMENTS

| | | | |
|---|---|---|---|
| 2,181,997 | 12/1939 | Malek | 112/121.22 |
| 2,211,768 | 8/1940 | Dorkin | 112/121.22 X |
| 2,286,224 | 6/1942 | Najtali | 112/121.22 |
| 2,397,081 | 3/1946 | Baker et al. | 112/121.22 |
| 2,748,729 | 6/1956 | Davidowitz | 112/121.22 |
| 3,000,334 | 9/1961 | Hedbrandh | 112/121.22 X |
| 4,029,032 | 6/1977 | Medynski et al. | 112/121.22 |
| 4,574,717 | 3/1986 | Junemann et al. | 112/121.12 |

*Primary Examiner*—H. Hampton Hunter

*Attorney, Agent, or Firm*—Bacon & Thomas

[57] ABSTRACT

Handling apparatus for use in conjunction with a sewing machine and a stitching template for sewing the longitudinal seam in a prepared tie blank. The apparatus comprises a table (1) designed to accomodate a base plate (2) of the sewing machine in a rear central region of the table. The table defines a template loading station (47*a*) at a front part of the table and to a first side of the table center, a template presentation station (47*b*) at a rear part of the table and to the first side of the table center, a template delivery station (47*c*) at a rear part of the table and to a second side of the table center and a template return station (47*d*) at a front part of the table and to the second side of the table center. Positioning means (69, 71) are provided at the loading station to assist in positioning the tie blank on the template. First drive means (33, 35) are provided for moving a loaded template from the sewing machine to the delivery station; second drive means (41) are provided for moving the template from the delivery station to the return station; and third drive means (46) are provided for moving the template from the return station towards the loading station.

6 Claims, 5 Drawing Sheets

HANDLING APPARATUS

This invention relates to handling apparatus for use in conjunction with a sewing machine and a stitching template in order to sew the longitudinal seam in a prepared tie blank.

The manufacture of neckties has always been recognised as a difficult process to automate. One machine is known that allows automatic stitching of the longitudinal seam of a prepared tie blank, with or without interlining material, but the machine is large, complex and expensive and it also has the disadvantage that the stitched tie is longitudinally wrinkled as a result of the stitching operation. A separate, additional operation is then needed to straighten the tie before it can be passed for furthr processing.

The object of the invention is to provide a simplified handling apparatus for tie stitching, that avoids the previous disadvantages.

According to the invention, handling apparatus for use in conjunction with a sewing machine and a stitching template for sewing the longitudinal seam in a prepared tie blank, comprises a table designed to accomodate a base plate of the sewing machine in a rear central region of the table, the table defining a template loading station at a front part of the table and to a first side of the table centre, a template presentation station at a rear part of the table and to the first side of the table centre, a template delivery station at a rear part of the table and to a second side of the table centre and a template return station at a front part of the table and to a second side of the table centre, positioning means at the loading station to assist in positioning the tie blank on the template; first drive means for moving a loaded template from the sewing machine to the delivery station; second drive means for moving the template from the delivery station to the return station; and third drive means for moving the template from the return station towards the loading station.

Using such handling apparatus the sewing machine need not be specially designed, as a template loaded with the tie blank is simply fed through the machine by the handling apparatus. The sewing machine will generally be a slipstitch machine, and desirably incorporates means for automatically driving the template past the needle of the machine, as is well known in the field of stitching templates.

The invention will be more readily understood from the following description of a specific embodiment thereof, given in conjunction with the accompanyng drawings, in which.

Figure 1:
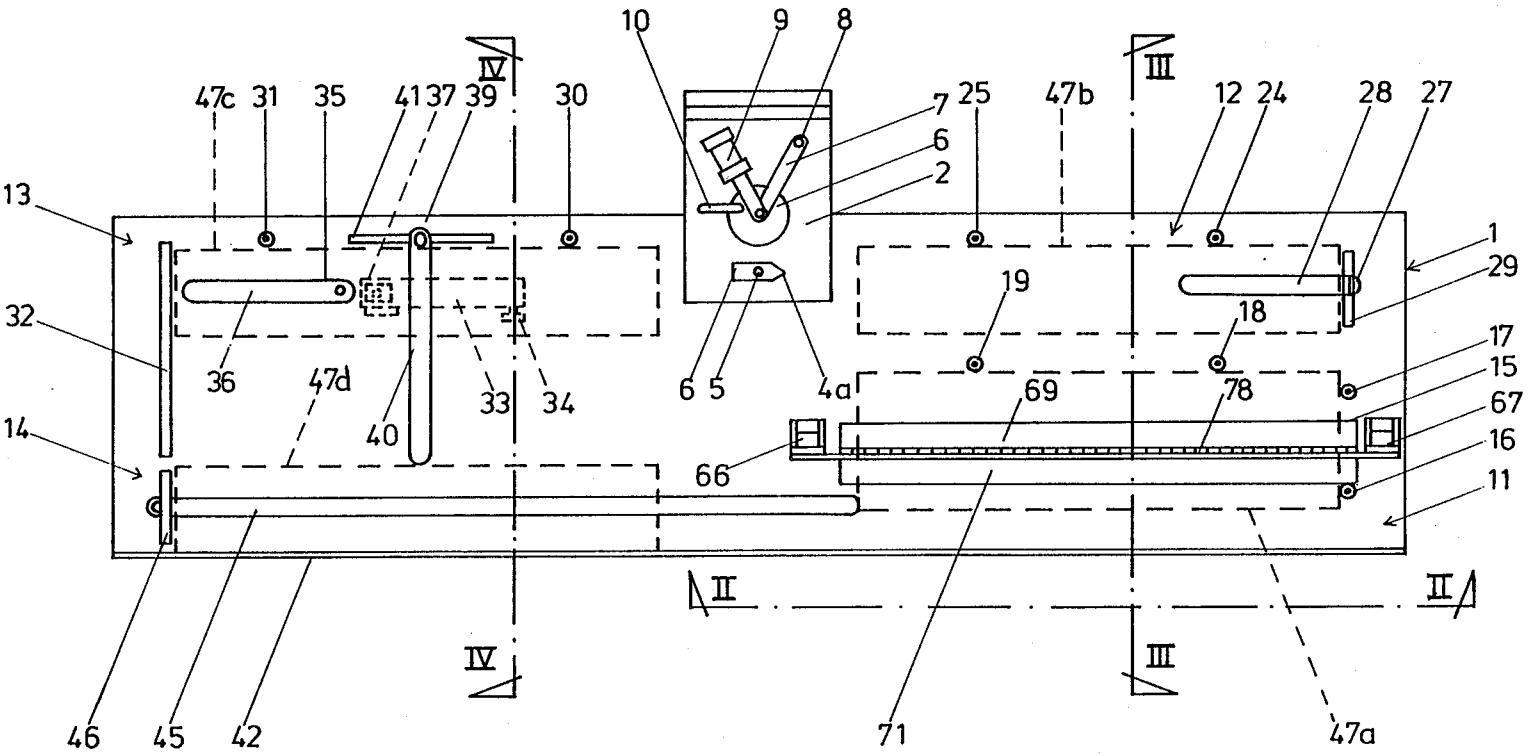
FIG. 1 is a general plan view of the handling apparatus.

Referring to FIG. 1 the handling apparatus comprises a table 1, which is cut-away in the rear, central region thereof in order to accommodate the base plate 2 of a sewing machine 3, not shown in any detail. It will be understood that parts of the machine are located above and parts below the table. The base plate incorporates an upstanding guide block 4 with a needle passage hole 5 through the block. A drive wheel 6 is rotatably mounted at one end of an arm 7 pivotally mounted at 8 on the base plate. The drive wheel 6 can be moved between the advanced position shown in FIG. 1 and a retracted position by a pneumatic ram 9, having a piston rod connected to the arm 7. When in the advanced position, the drive wheel 6 can be intermittently driven in the clockwise direction as shown in FIG. 1 by a drive applied through a slipping clutch from a reciprocating arm 10 linked to the sewing machine mechanism. The drive is such that the drive wheel only moves when the needle of the machine lies out of engagement with the workpiece. This type of mechanism is well known in the art, and does not require detailed description.

The machine used with the invention is conveniently the AMF model 70-52 machine manufactured by Automated Machinery Systems, Inc., and capable of effecting slip-stitching at variable stitching densities.

The table defines a template loading station generally shown as 11 at the front right-hand part of the table, a template presentation station 12 at the rear right-hand side of the table, a template delivery station generally shown as 13 at the left-rear part of the table and a template return station 14 at the left-front part of the table.

Figure 3:
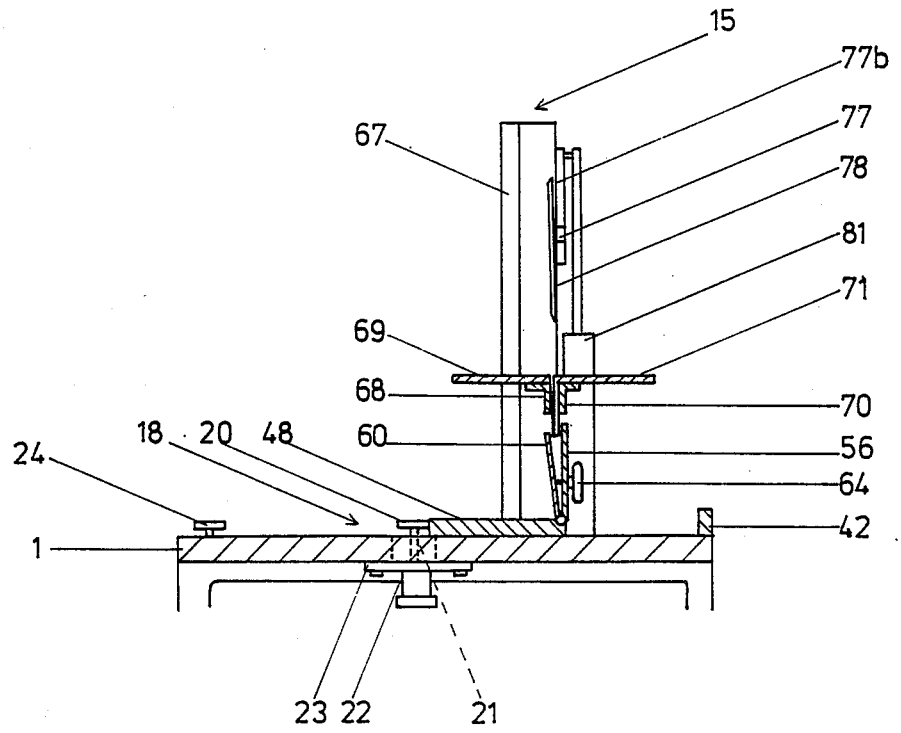
FIG. 3 is an enlarged cross-section taken on the line III—III of FIG. 1.
Figure 4:
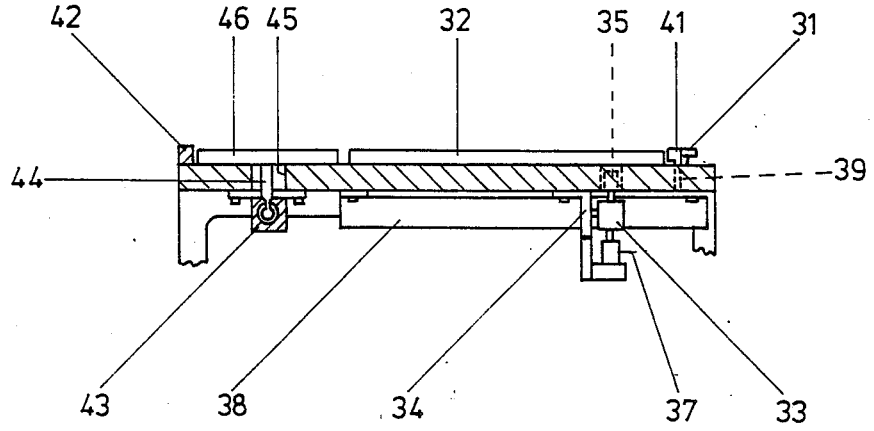
FIG. 4 is an enlarged cross-section taken on the line IV—IV of FIG. 1.

Tie-positioning and loading apparatus shown generally as 15 and to be described in detail later, is located at the loading station 11. The loading station includes two locating members 16 and 17 for locating a template longitudinally of the table, and a further two locating members 18 and 19 for locating the template fore and aft of the table. Each of the locating members 16 to 19 comprises a roller bearing. In the case of members 16 and 17 the roller bearings are mounted on pins secured to the table. For members 18 and 19, however, each roller bearing such as 20 is carried at the upper end of a piston rod 21 of a pneumatic ram that also includes a cylinder 22 secured by mounting means 23 to the underside of the table. The ram is effective to move the roller bearing between a raised position as shown in FIG. 3, and a lowered position in which the bearing is retracted into an opening through the table.

The presentation station includes locating members 24 and 25 for locating the template fore and aft of the table, and each of these locating means may be a roller bearing mounted on a pin that is secured to the table. A pneumatic ram 26 is mounted below the table and has a drive member 27 projecting upwardly through a slot 28 formed in the table surface. The drive member carries a drive plate 29 above the table surface, the drive plate being engageable with one end of a template when at the presentation station 12. The ram 26 is of the floating piston type, the drive member 27 projecting upwardly through a seal in the upper surface of the ram cylinder and capable of opeing and closing behind the drive member. A suitable ram is that manufactured and sold by Origa Ltd of the United Kingdoom under the name "Rodless Cylinder".

The delivery station includes longitudinally aligned roller bearings 30, 31 towards the rear of the table, for locating the template fore and aft of the table, and a locating rib 32 for locating the template longitudinally of the table. The cylinder of a ram 33 is pivoted on a support 34 beneath the table at the delivery station, and the piston of the ram carries a block 35 which can move along a slot 36 in the table. The ram is normally in a lowered position wherein the block 35 lies below the table surface, but can be raised at its front part by extension of a further ram 37 in order to raise the block 25 to a position where it can engage a drive recess on the bottom of the template.

Also mounted below the table at the delivery station is a ram 38, which may be similar to the ram 26, with a driving member 39 projecting upwardly through a slot 40 formed in the table and carrying a drive plate 41 lying above the table surface. In the retracted position of this ram the plate 41 lies in alignment with, or slightly rearwardly of, the forwardmost areas of roller bearings 30 and 31. The front of the table is formed with a raised rib 42 extending the full length of the table. At the return station 14 a further ram 43, which may again be similar to the ram 26, is mounted below the table and has a drive member 44 projecting upwardly through a slot 45 cut in the table surface. The drive member carries a drive plate 46 lying above the table surface.

Figure 5:
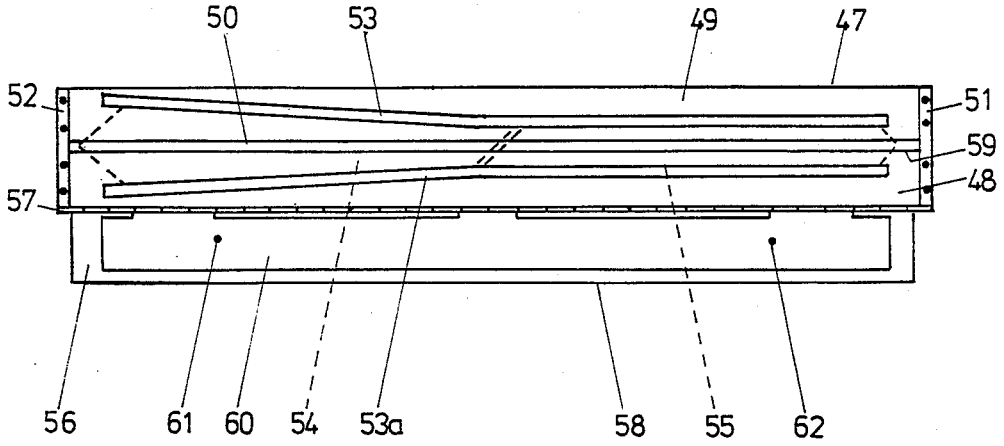
FIG. 5 is an enlarged plan view of a stitching template for use with the apparatus, in an open condition.
Figure 6:
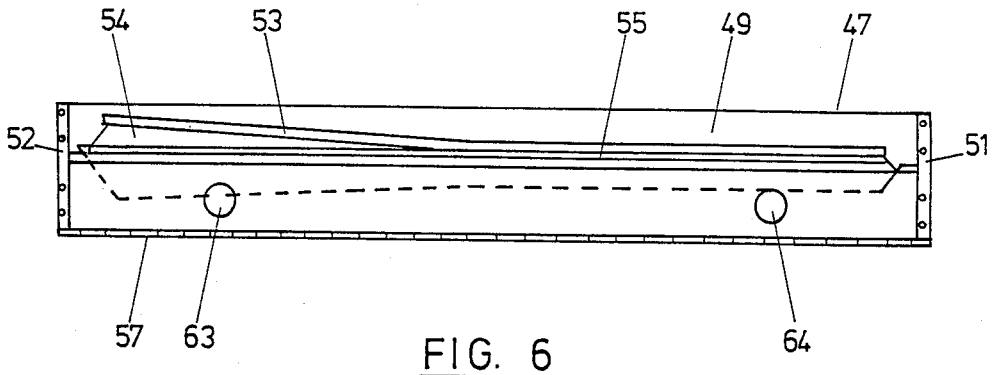
FIG. 6 is a view similar to FIG. 5 showing the template in a closed and loaded condition.

Referring now to FIG. 5, this shows a template for use in the machine. The template comprises a base plate 47 having front and rear sections 48 and 49 respectively, separated by a guide slot 50. The two sections are joined by bridge pieces 51, 52 which span the slot at the two ends of the template. The rear plate 49 has marker strips 53, 53a thereon, which act as guides for the placement of tie interlining sections shown in broken outline at 54 and 55.

The template further includes an upper plate 56 which is hinged to the front plate 48 along a hinge line 57, the free edge 58 of the upper plate being shaped so that when folded into a position overlying the plate 48 the edge 58 lies in alignment with the front edge 59 of the guide track 50. An intermediate plate 60 is also pivoted to the front plate 48 along the hinge line 57 and lies immediately adjacent to the upper plate 56. Two pins 61, 62 extend through corresponding openings in the upper plate and terminate in knobs 63, 64 respectively. A compression spring such as 65 surrounds each pin and is located between the upper plate 58 and the knob 63 or 64, so biasing the intermediate plate 60 into face to face contact with the inner surface of the upper plate 58. However, by pushing the knobs 63, 64 the intermediate plate 60 may be moved away from the upper plate 58 as illustrated in FIG. 3.

The tie-positioning and loading apparatus 15 shown in FIG. 3 comprises two pillars 66, 67 one located to each side of the loading station. An angle section 68 that is fixed in position between the pillars 66, 67 supports a plate 69. A further angle section 70 supports a further plate 71, a gap 72 being left between the facing edges of plates 69 and 71 and between the angle sections 68 and 70. A strip 70a projects downwardly from the angle section 70. The angle section 70 is supported at each end thereof on the piston rod 73, 74 respectively of pneumatic rams 75, 76 having the cylinders that are each fixed to the adjacent pillar. The rams are operable so that the plate may be moved from a position of horizontal alignment with plate 69 (shown in FIG. 3) to a position wherein the plate 71 is raised above the level of the plate 69.

A support bar 77 is secured at opposite ends to slides **77*a*, 77*b* engaging slideways on the respective pillars 66 and 67. The support bar 77 carries a plurality of fingers such as 78, each of which is capable of individual vertical adjustment relative to the support bar, and of being secured in a desired adjusted position. The fingers have pointed lower ends and they lie in a row which is in longitudinal alignment with the gap 72 between the support plates 69 and 71. The slides 77*a*, 77*b* are vertically movable on the pillars 66, 67 by pneumatic rams 80, 81**.

Figure 2:
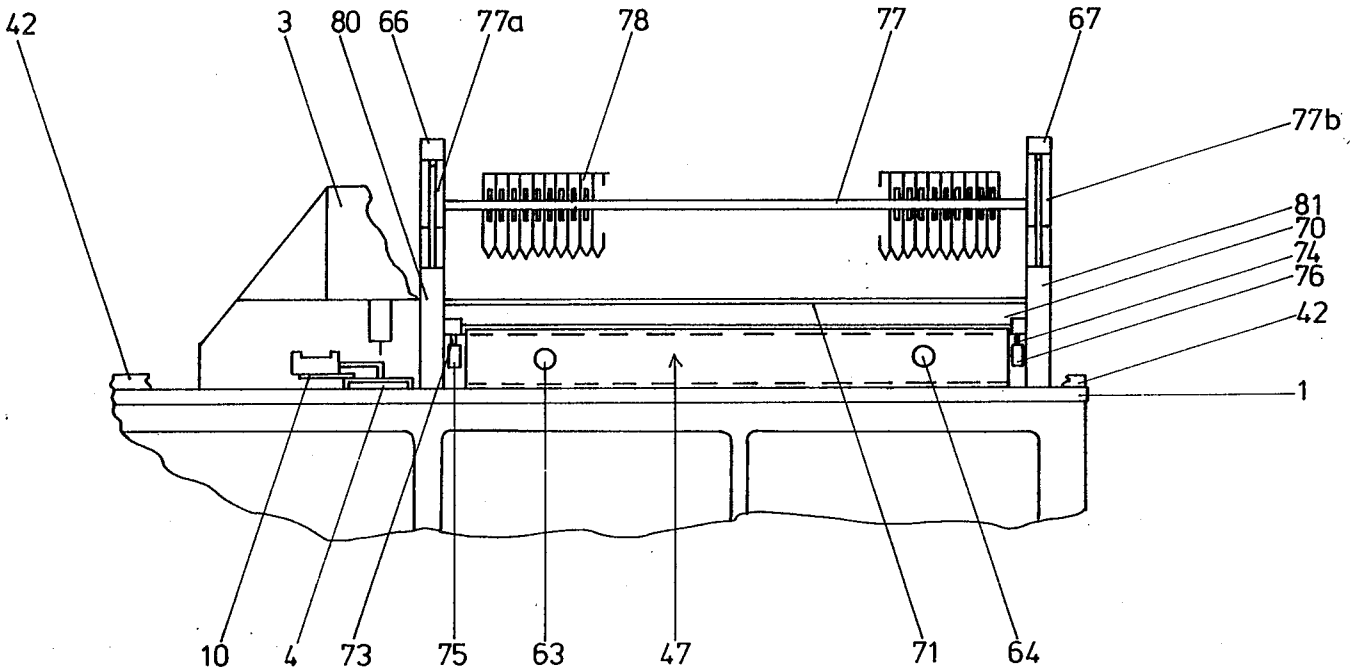
FIG. 2 is an elevation of the right-hand part of the apparatus in the direction of the arrow II of FIG. 1.

Operation of the apparatus will now be described, assuming a starting position wherein an empty template 47a is open and is located at the loading station 11. The locating members 18 and 19 are thus in their raised positions, the drive plates 29, 41 and 46 are in the positions shown in FIG. 1, and the ram 33 is lowered and retracted, as again shown in FIG. 1. The rams 75, 76 are retracted so that the support plates 69 and 71 are in horizontal alignment, and the support bar 77 is in the raised position as shown in FIG. 2, with the fingers having being adjusted and locked to give the desired profile. An operator first lays two pieces of interlining fabric 54, 55 onto the opened jig, aligning the fabric with the marker strips 53, 53a so that the centre line of the fabric lies along the centre line of the slot 50. A preformed length of tie fabric, i.e. a tie blank, is then laid on the plates 69, 71 so that the centre line of the fabric lies along the slot 72 between the two plates. The upper surfaces of the plates may be formed with markers or guides to assist this positioning. The operator then lifts the upper plate 56 of the template to the position shown in broken lines in FIG. 3, where the upeer part of that plate engages the strip **70*a* projecting downwardly from the angle section 70. The operator then pushes the knobs 63, 64 so moving the intermediate plate 60 away from the upper plate 56 and creating a gap therebetween. By operation of an appropriate control, for example a foot switch, the rams 80, 81 are operated to lower the support bar 77 so driving the fingers 78 downwardly through the gap between plates 69, 71 and into the space between the intermediate plate 60 and upper plate 56. This movement has the effect of folding and driving downwardly the tie blank that has previously been positioned on the plates 69, 71, and the profile to which the fingers 78 have been set is such that a straight edge strip of tie fabric projects beyond the edge 58 of the upper plate 56. The support bar 77 is then raised, and the rams 75, 76 are extended to raise the angle section 70. This removes the strip 72*a* from behind the upper plate 56 which can then be lowered over the plate 49 into the closed position of the template as shown in FIG. 5**.

A further control is then operated to actuate the rams such as 22 so that the locating members 18 and 19 are retracted into the table top. The loaded template is then pushed rearwardly over the table to the presentation station, either manually or by a further pneumatic ram (not shown), where the template **47*b* engages the locating members 24, 25. The locating members 18 and 19 are returned to their raised positions. Ram 28 is then operated so as to drive the template to the left as shown in FIG. 1 and to engage the guide slot 50 of the template over the guide block 4 on the sewing machine base plate 2. The guide block 4 may have a tapered nose section 4*a*** in order to facilitate this engagement. The ram 9 is advanced so that drive wheel 6 moves into frictional engagement with the rear edge of the template, and the sewing machine is then operated, with the drive wheel driving the template through the sewing machine in synchronism with movement of the needle. A slip stitch seam is thus sewn along the centre line of the guide track from one end of the tie to the other.

As stitching progresses, the template is driven by drive wheel 6 from the presentation station through the sewing machine to the delivery station, and the leading edge of the template will be guided by the roller bearings 30 and 31. When stitching has been completed, drive is no longer provided by the drive wheel 6. Accordingly ram 37 is extended to raise ram 33 to engage the block 35 with the template, and ram 33 is extended so that the block 35 pushes the template fully from engagement with the machine and into its position 47*c* at the delivery station, where the leading edge of the template engages the locating rib 32.

If desired,the template may be opened while at the delivery station and the stitched tie unloaded therefrom, either manually or automatically, the template being closed after unloading. Alternatively the template may remain in its loaded condition. In either event, the ram 38 then operates to cause the template to be pushed from the delivery station to the position 47*d* at the return station, the template engaging the rib 42. The ram 43 then operates to drive the template from the return station back to the loading station and into the control of the operator. The operator opens the template and pushes it back over the table to engage the raised locating members 18, 19. It will be understood that, rather than unload the template at the delivery station 13 it may alternatively be unloaded at the return station 14, or even at the loading station 15 before a re-loading operation commences.

Control of movement of the template through the apparatus can be manual, semi-automatic or automatic. If under manual control then each template movement will be controlled from an appropriate switch that is actuated by the operator. In semi-automatic or automatic control then sensing means such as microswitches or photoelectric cells will be incorporated at appropriate locations on the apparatus to sense the correct location of a template at that station and to initiate the operations then required. Such control means will readily be apparent to those skilled in the art and do not require detailed description.

Figure 7:
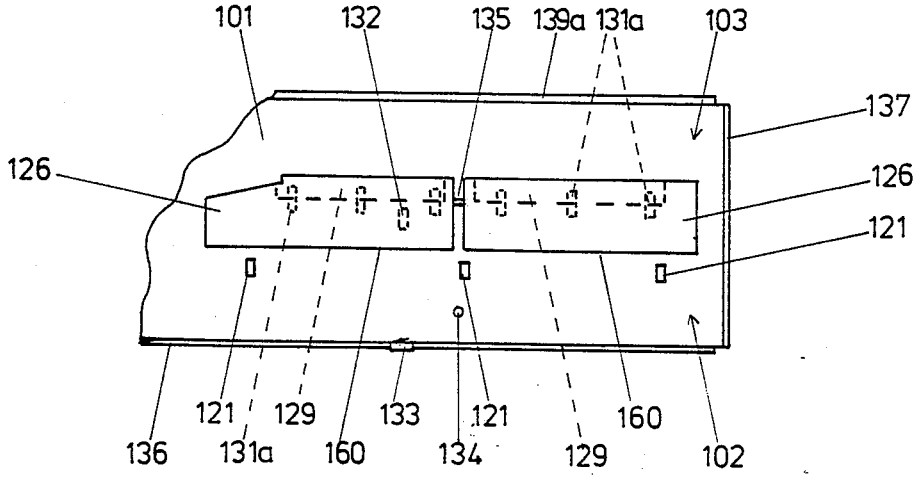
FIG. 7 is a general plan view of the right hand part of an alternative embodiment of handling apparatus.
Figure 8:
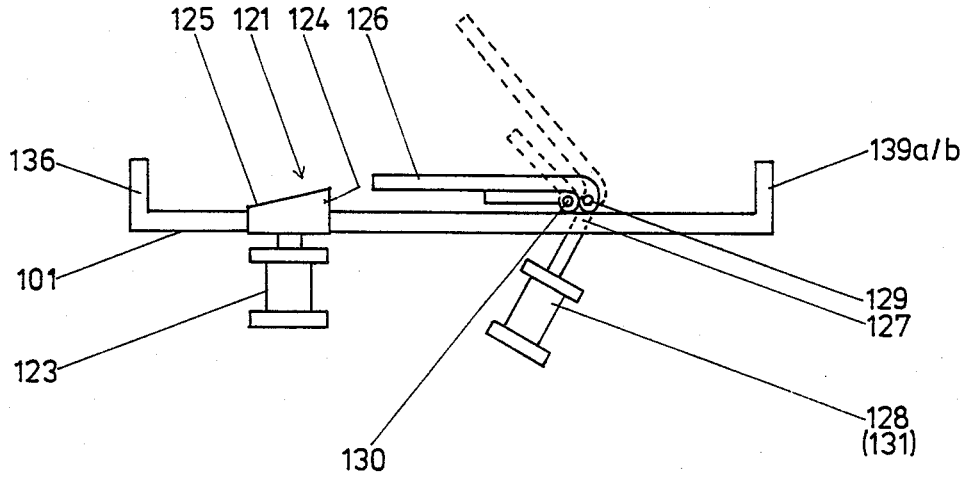
FIG. 8 is an elevation of the right hand part of the apparatus in the direction of the arrow VIII in FIG. 7.

FIG. 7 and 8 show an alternative arrangement of the righthand part of the apparatus. The figures show a section of a table 101 defining a template loading station generally shown as 102 at the front part of the table and a template presentation station 103 at the rear part of the table.

At the template-loading station there are a plurality (e.g. three) of ramps 121 projecting upwardly through openings in the table. Each ramp is carried by a pneumatic ram 123 to be movable between a raised position as shown in FIG. 8 and a lowered position wherein the ramps lie wholly beneath the table surface. In the raised position the ramps provide a locating surface 124 facing towards the back of the table together with an upper surface 125 sloping upwardly towards the rear of the table. Positioned behind the ramps are two similar, adjacent folding blades 126 each pivotally mounted on the table by a hinge arrangement 127. Each blade can be moved from the lowered position shown in FIG. 8 to a raised position as shown in broken lines in that Figure by a ball end carried by the piston rod of a pneumatic ram 128. Lying beneath the folding blades 126 are additional tie-positioning blades 129, again pivoted at their rear edges to the table by hinges 130, and capable of being lifted to the broken-line position shown in FIG. 8 by further rams 131. The tie-positioning blades have feelers 131a projecting from their front edge, the feelers being forwardly and rearwardly adjustable on the blade so that they can be set at a required profile.

The rams 127, 128 and 129 are operated under the control of micro-switches 132, 133, of push button switches 134, 135 sunk into the table top and of further switches on a control console not shown. The sequence of control will be described hereinafter.

The front edge of the table has an upstanding wall 136, the ends of the table have upstanding end walls 137, 138, and the rear edge of the table has rear wall sections 139*a*, 139*b*.

Figure 9:
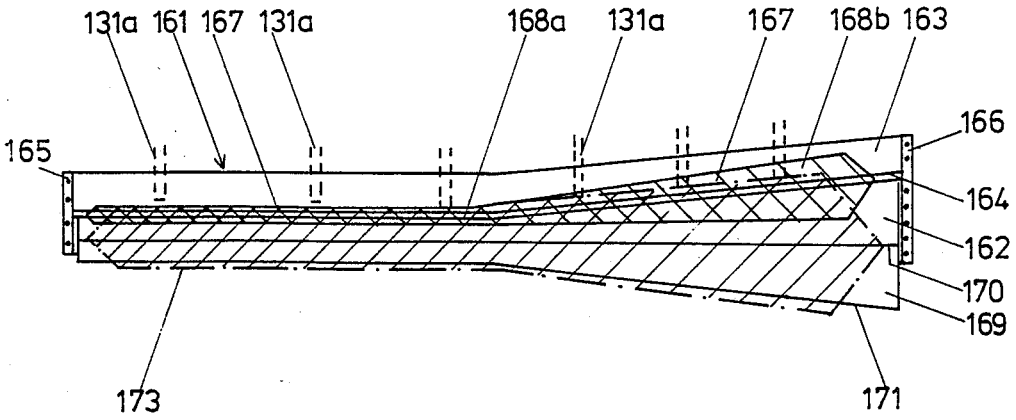
FIG. 9 is an enlarged plan view of a stitching template for use with the apparatus of FIG. 7.

Referring now to FIG. 9, this shows a template for use with the apparatus of FIG. 7. The template comprises a base plate 161 having front and rear sections 162, 163 respectively separated by a guide slot 164. The two sections are joined by bridge pieces 165, 166 which span the slot at the two ends of the template. The rear plate 163 has marker lines 167 thereon, which act as guides for the placement of tie interlining sections 168*a*, 168*b*.

The template further includes a plate 169 which is hinged to the front plate 162 along a hinge line 170, the free edge 171 of the plate being shaped so that when folded into a position overlying the plate 162 the edge 171 lies in alignment with the front edge of the guide track 164.

Prior to the commencement of operation of the apparatus the parts thereof are as shown in FIGS. 7 and 8, with the jig ramps 121 withdrawn below the table top, the folding blades 126 and tie positioning blades 129 both in their lowered positions.

A console switch is operated to cause extension of rams 128 and 131, thus lifting the folding blades 126 and tie positioning blades 129. An empty template, with the flap 169 folded to an open position is located in a starting position, one end of the template engageing the end wall 137 of the table and the lower surface of the template closing the micro-switch 132 to cause the ram 123 to lift the ramps 121. The template is pulled back to locate against the upstanding faces 124 of the ramps. The interlining fabric 168*a*, 168*b* is then laid on the template to the position defined by the marker lines and the plates carrying the positioning blades are then lowered onto the jig by operation of switch 135 and retraction of rams 131. Tie fabric 173 is then positioned according to the outline defined by those blades.

Switch 134 is then operated whereupon the folding blades 126 drop over the tie fabric so that the front edges 160 of those blades lie along the centre line of the tie fabric, immediately adjacent to the hinge line 170. The plates thus hold the tie fabric, interlining and template in place on the table. The plate 169 of the template is now folded over the plate 162 so that the tie fabric is folded around the edge 160 of the blades 126, thus effecting a fold along the centre line of the tie fabric.

The ramps 121 are lowered, and the loaded template is then pulled from beneath the blades 126 over the lowered ramps to the front wall 136 of the table where the front edge of the jig closes the micro-switch 133. This causes the ramps 121 to be raised and the loaded template can then be pushed over those ramps, which lift the template so that it moves smoothly over the lowered plates 126 into the template-presentation station 112 at the rear of the table.

The plate is then moved, either manually or automatically so that the guide track engages the guide block of the sewing machine and operation continues as already described.

In practice, either form of the handling apparatus can be dealing with two templates simultaneously. As soon as one has been loaded and moved from the presentation station into control of the stitching apparatus a further template may be loaded. By the time loading has been completed, the first template will have moved to the delivery station so that the second loaded template may then be moved to the presentation station. The first template is then moved from the return station back to the loading station, and the cycle is repeated.

It will be appreciatd that the apparatus described can be modified in many different ways, so long as the essential locating and driving functions are effected.

I claim:

1. Handling apparatus for use in conjunction with a sewing machine and a stitching template for sewing the longitudinal seam in a prepared tie blank; the apparatus comprising a table designed to accomodate a base plate of the sewing machine in a rear central region of the table, the table defining a template loading station at a front part of the table and to a first side of the table centre, a template presentation station at a rear part of the table and to the first side of the table centre, a template delivery station at a rear part of the table and to a second side of the table centre and a template return station at a front part of the table and to the second side of the table centre; positioning means at the loading station to assist in positioning the tie blank on the template; first drive means for moving a loaded template from the sewing machine to the delivery station; second drive means for moving the template from the delivery station to the return station; and third drive means for moving the template from the return station towards the loading station.

2. Handling apparatus according to claim 1 in which the loading station includes first locating means for locating the template longitudinally of the table and second locating means for locating the template fore and aft of the table.

3. Handling apparatus according to claim 2 in which the second locating means are retractable below the table top to allow movement of the template from the loading station to the presentation station.

4. Handling apparatus according to claim 1 in which each of said first, second and third drive means comprises a pneumatic ram.

5. Handling apparatus according to claim 1 in which the presentation station includes third locating means for locating the template fore and aft of the table, and fourth drive means for moving the template from the presentation station along the table towards the sewing machine.

6. Handling apparatus according to claim 5 in which said fourth drive means comprises a pneumatic ram.

* * * * *